US009119455B2

(12) United States Patent
Zhang

(10) Patent No.: US 9,119,455 B2
(45) Date of Patent: Sep. 1, 2015

(54) FOLDING COMPONENT COMPACT

(75) Inventor: Derik Zhang, Liaobu Town Dongguan (CN)

(73) Assignee: Lava Industries Inc., Monterey Park, CA (US)

( * ) Notice: Subject to any disclaimer, the term of this patent is extended or adjusted under 35 U.S.C. 154(b) by 0 days.

(21) Appl. No.: 13/507,738

(22) Filed: Jul. 25, 2012

(65) Prior Publication Data

US 2014/0026921 A1 Jan. 30, 2014

(51) Int. Cl.

| | |
|---|---|
| ***A45D 33/24*** | (2006.01) |
| ***A45D 33/00*** | (2006.01) |
| ***A45D 33/22*** | (2006.01) |
| ***A45D 40/22*** | (2006.01) |

(52) U.S. Cl.

CPC ..... *A45D 33/008* (2013.01); *A45D 33/22* (2013.01); *A45D 40/221* (2013.01)

(58) Field of Classification Search

CPC . A45D 33/003; A45D 33/006; A45D 33/008; A45D 33/18; A45D 33/22

USPC ..... 132/293–298, 300–301; 206/37, 581, 206/823, 748, 4.22, 4.23; 220/4.22, 4.23

See application file for complete search history.

(56) References Cited

U.S. PATENT DOCUMENTS

| | | | | |
|---|---|---|---|---|
| 1,841,933 | A * | 1/1932 | Bowers | 132/296 |
| 3,256,892 | A * | 6/1966 | Esposito, Jr. | 132/300 |
| 6,223,754 | B1 * | 5/2001 | Burdi et al. | 132/300 |
| 6,712,076 | B2 * | 3/2004 | Alexander et al. | 132/300 |

* cited by examiner

*Primary Examiner* — Todd Manahan
*Assistant Examiner* — Brianne Kalach
(74) *Attorney, Agent, or Firm* — William W. Haefliger

(57) ABSTRACT

A folding component cosmetic compact, the combination comprising a base, insert and cap components, there being a first hinge connecting the insert to the base and a second hinge connecting the insert to the cap, at least one of the hinges being a living hinge.

9 Claims, 3 Drawing Sheets

FOLDING COMPONENT COMPACT

BACKGROUND OF THE INVENTION

This invention relates generally to improvements in cosmetic compacts, and more particularly to a one-piece pressed powder compact in which three elements fold together as will be described.

There is need for simplicity in configuration of cosmetic compacts allowing enhanced eases of use and handling, as well as facilitating ease of manufacturer of the multi-component compact as will be seen.

In this regard, usually a pin is used to connect a compact top and a base, undesirably affecting the overall aesthetic appearance of the compact. Such a pin is made of metal, and not only is not environmental friendly, but production time will also be lengthened due to the fact that assembly will be required, increasing the unit cost. Further, two piece compacts with a hinge exposed on the outside, affect the visual aesthetic of the device. In addition, such a hinge cannot be opened to specific angles, therefore is not useful for the consumer.

SUMMARY OF THE INVENTION

It is a major object of the invention to provide an improved folding cosmetic compact that comprises:

a) base, insert and cap components, b) a first hinge connecting the insert to the base and a second hinge connecting the insert to the cap, c) at least one of those hinges being a living hinge.

As will be seen, both of the hinges are preferably living hinges, and the components have a sequentially extended position in which the hinges are unfolded. In this regard, the components typically have a collapsed position in which the hinges are folded and concealed.

Another object is to provide a Z-shaped compact in which the base has a re-entrant recess into which the insert projects, the cap then overlying the base, insert, and the living hinges. The living hinges plus three elements of the device enable construction in a one-piece foldable and unfoldable configuration, as will appear.

A further object is to provide a one-piece construction, in which the base, insert, and cap have a stair-step configuration in extended position. This facilitates concealment of the living hinges and a closing clutch in closed together positions of the compact elements, and enables ease of such closing in one swift hand controlled movement.

Yet another object is to provide an improved compact to overcome the current technology restraints and to produce a single piece compact which can be cost-effective, environmentally-friendly as well as aesthetically appealing.

These and other objects and advantages of the invention, as well as the following specification and drawings, in which:

DRAWING DESCRIPTION

DETAILED DESCRIPTION

Figure 1:
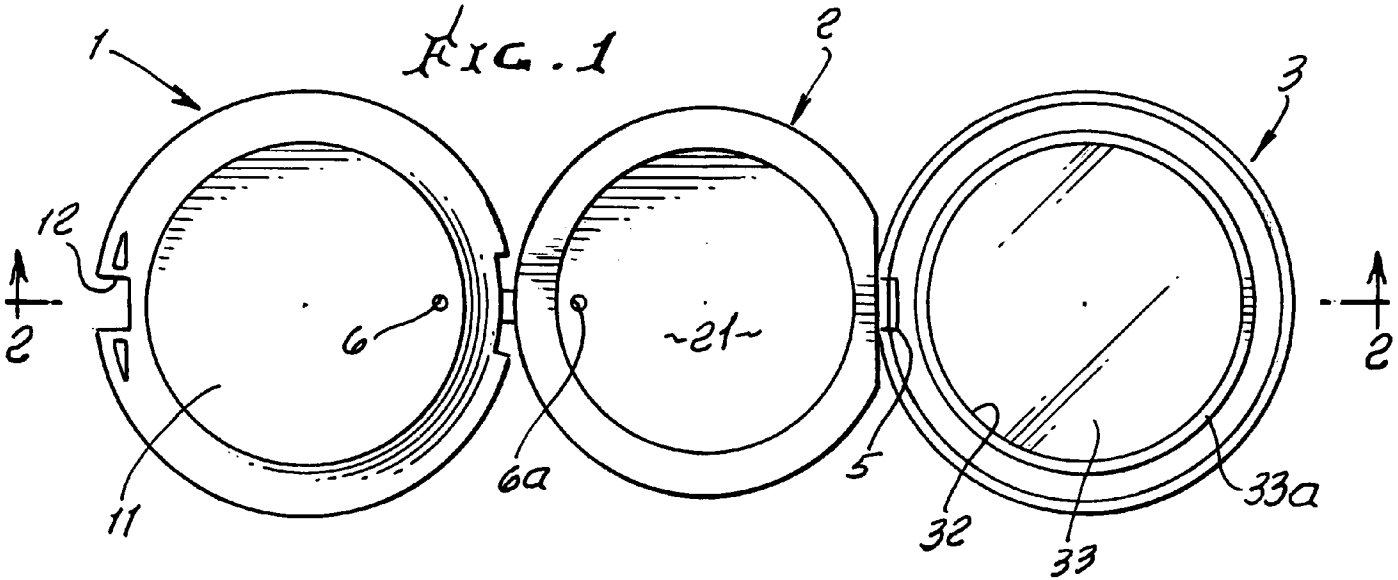
FIG. 1 is a plan view of the improved compact of the invention, in fully opened and extended position.

In FIG. 1, the molded plastic receptacle shaped base 1, insert 2, and cap 3 are shown sequentially connected together by living hinges at 4 and 5. Small vent openings 6 and 6*a* are provided in the base and insert to register in closed, folded position of the compact, as appears in FIG. 5.

Figure 2:
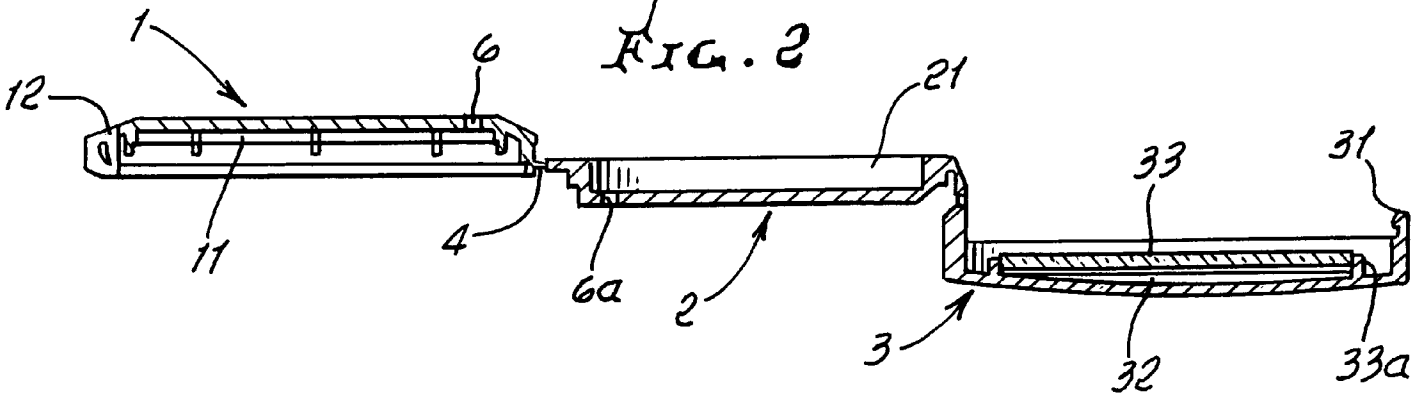
FIG. 2 is a section taken along 2-2 of FIG. 1.
Figure 6:
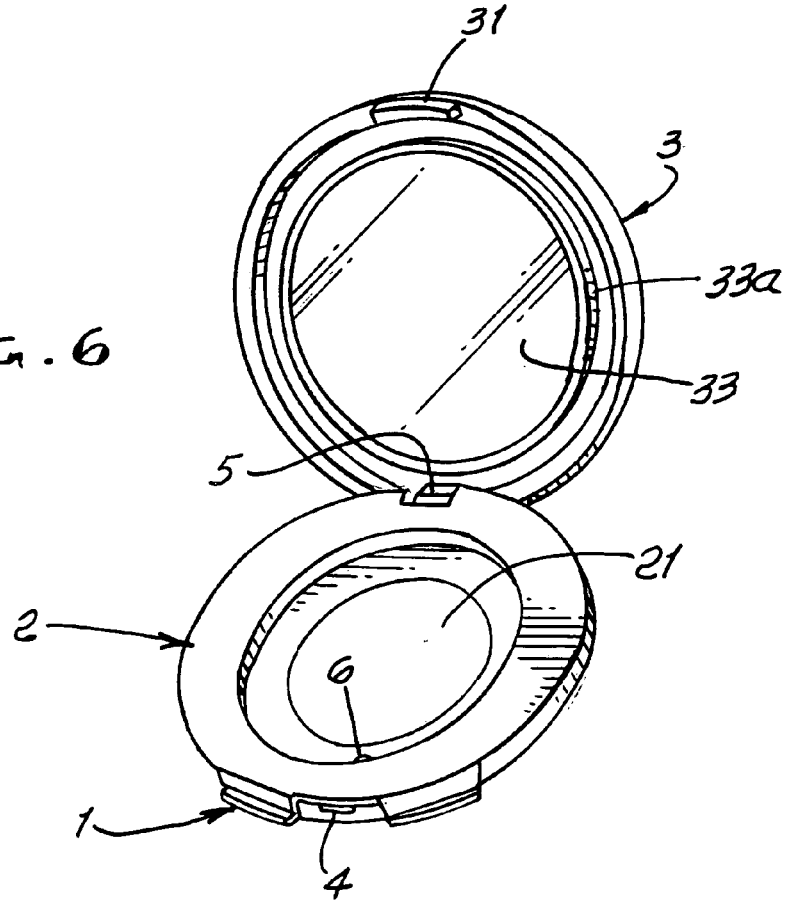
FIG. 6 is a perspective view of the cap in open position; above the closed together insert and base.

As shown in FIG. 2, the completely opened, longitudinally extended position of the device locates the base, insert and cap in stair-step configuration, facilitating molding together with the reduced thickness living hinges, 4 and 5 and accurate registration of the elements 1-3, as in FIG. 6. In FIG. 2, the base is upwardly re-entrant at 11; the insert i.e. mid-compartment 2 is downwardly at 21; and the cap 3 is downwardly re-entrant at 34. A mirror 33 fits into space 34, and is peripherally retained by or between a projection or projections 33*a*.

Figure 5:
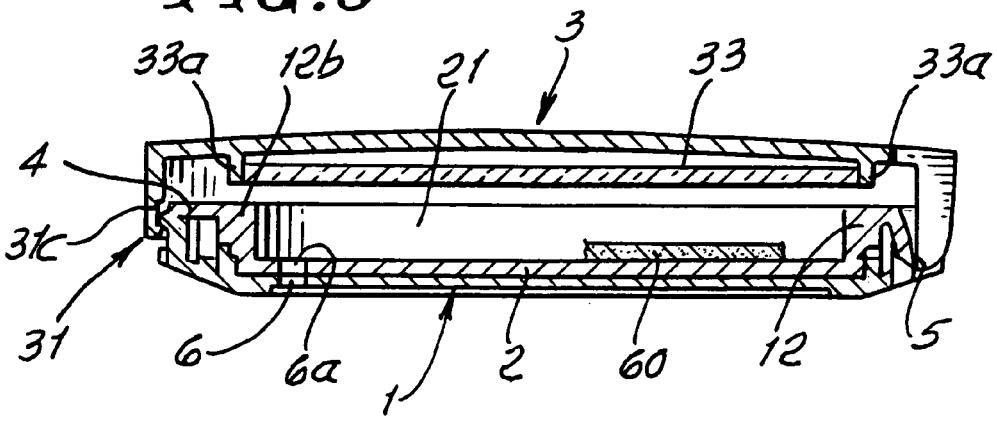
FIG. 5 is an enlarged section taken through the fully closed compact.

The venting through openings 6 and 6*a* pass air from the compact interior, to the exterior, as the three elements are closed together to FIG. 5 position, so as not to disrupt cosmetic powder in re-entrant space 21 upon closing; i.e. the openings 6 and 6*a* serve as pressure relief openings, as the cap is closed, preserving clarity of the mirror surface 33*a*.

Figure 4:
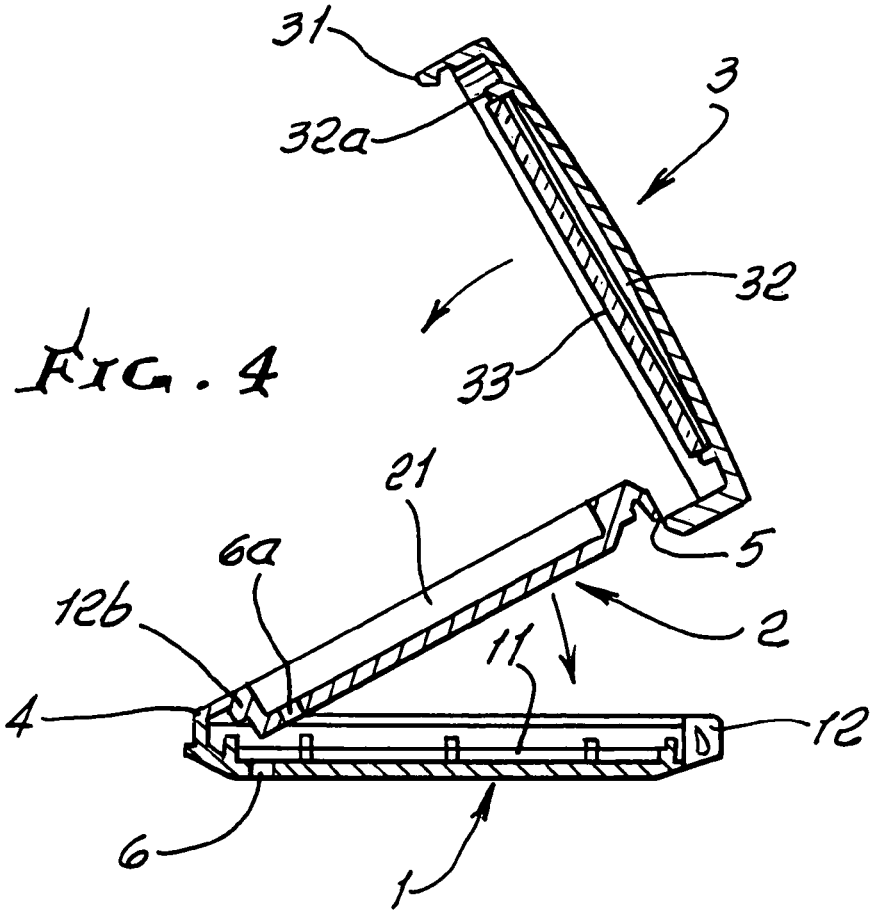
FIG. 4 is a partly folded view of the compact, showing Z-shape of the elements.

FIG. 4 shows the moving, i.e. collapsing Z-shape of the device as the elements 1, 2 and 3 are relatively folded together toward FIG. 5 position. Living hinge 5 collapses to closed and retained position between base wall portion 12 and cap wall portion 12*a*, and living hinge 4 collapses between insert wall portion 12*b* and cap wall portion 31, appearing as in FIGS. 1 and 5. As such, they become concealed. Those wall portions also serve to assist guiding of the cap and base into correct registration with the insert, as the living hinges are encompassed, during closure. Thus, the living hinges perform multiple functions (hinging, guiding and concealment).

Figure 3:
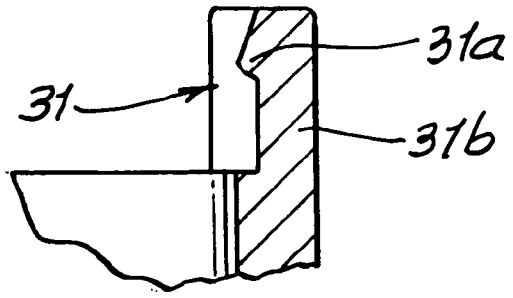
FIG. 3 is an enlarged section showing a clasp configuration at the right end of the FIG. 2 illustrated device.

FIG. 5 shows pressed cosmetic powder at 60, in insert space 21, and facing toward mirror 33. In that view, the assembly is shown with walls encompassing the living hinges as well as a clasp 31, releasably holding the components in closed position. The clasp is provided by a detent projection 31*a* on outstanding from base wall portion 31*b*; that projection releasably fitting a recess 31*c* in the cap wall. See also FIG. 3.

Components 1, 2 and 3 may be generally circular as shown in FIG. 1. The two hinges and clasp components are linearly aligned, in FIGS. 1 and 2.

This item provides a new innovative cosmetic configuration of a one piece pressed powder compact, which includes a base, an insert, as well as a cap. A living hinge connects the base with the insert, and after folding, the insert projects into the base to form a single piece device. Another living hinge connects the same insert with the cap which closes with a clutch at the cap front. After closing, each of the living hinges become enclosed into the actual device, so that none of the hinges appear at the outside. The base, living hinges, insert, as well as the cap are all incorporated in a one piece product, enabling simultaneous production, and improving external appearance with reduced production and manufacturing time and cost. In addition, the cap can be opened and kept opened at any angle preferred by the user.

One living hinge connects the base with the insert, and after folding, the insert folds into the base to form a single piece. Another living hinge connects the insert with the cap and folds and closes with a clutch or clasp at the front. After closing, the living hinges become enclosed into the collapsed compact, i.e. neither is shown on the outside.

The base has a mid-area or zone for accommodating reception of the insert as well as the living hinge, while also providing a cavity in the insert to contain the pressed powder after assembly. The shapes of the base, and the cap, are adjustable to the shape of the insert, as well as to the shape of the powder pan to be used.

Further, after the base and the insert are closed, the living hinge between the base and insert also becomes a clasp for retention of the cover after it closes to lock on. The living hinge between the cap and insert does not show on the outside, but is rather enclosed into the base. In this regard, after the first living hinge folds toward the base, the second living hinge fits into the base, so as not to be seen from the outside, and providing a dual and sequential closing sensing feel.

Further, the cap typically contains a mirror. The material of the whole compact consists of synthetic resin such as polypropylene.

This invention provides a new innovative cosmetic compact with improved functionality as well as providing a one-piece pressed powder compact, which includes a base, an insert, as well as a cap. In the past, a pin was used to connect the top compact and the base, detracting from the overall esthetic of the compact. The pin was made of metal and not only was it not environmentally friendly, but production time was lengthened due to the fact that pin assembly was required, increasing the unit cost.

Two-piece compacts with one living hinge, have been made, however, it was exposed on the outside, adversely affecting the visual aesthetic and usage of the compact. In addition, such prior living hinges cannot be opened to specific angles, therefore are not useful for the consumer.

An important purpose of this one-piece compact configuration is to overcome current technology restraints and to provide a single piece compact which can be cost-effective, environmentally friendly, as well as to be usefully attractive. It provides living hinge structure which connects the base with the insert, and the insert with the cap. A living hinge which connects the base with the insert, after folding, folds into the base to form a single piece. After the base and the insert are closed, the living hinge becomes a clasp for the cover when it folds down to lock position. Another living hinge connects the insert with the cap, and it folds into the base and the cap closes with the clutch at the front. After all structure closes, all the living hinges are encompassed into the actual device.

Also, the base provides an area to accommodate the insert as well as the living hinge, and the insert has a cavity for pressed powder. The shape of the base is adjustable to the shape of the insert, as well as the shape of the powder to be used. In addition, the base has an area to accommodate both the second living hinge for the cap and the insert. After the base and the insert are closed, the living hinge becomes a clasp for the cover when it folds down to lock on. Further, the cap has the capacity to contain a mirror, if needed.

This three-piece structure is produced, as by molding, at one time, reducing manufacturing time and cost. The structure is made of polypropylene and is environmentally friendly. The simple mechanism, with one-time, one-piece production, as well as no usage of pins, reduces time and complexity of compacts, thus increasing cost-efficiency. The cap allows the user to open the device at desired angularity. The living hinges are covered by the clasp of the cover, and the cavity of the base covers the second living hinge on the inside. After closing, both living hinges are totally enclosed on the inside of the device, improving the appearance as well as resolving problems of weakness of traditional pivots, which usually protrude on the outside.

As will be seen, the compact has a linearly extended position, in which the base, insert and cap extend in substantially parallel relation, the cap and base located at different levels.

Also, the insert as seen in FIG. 2 is located at a level between the cap and base levels.

Further, the cap, insert and base are generally circular in outline, the first and second hinges located at opposite ends of the insert and on a line bisecting the cap, insert and base.

What is claimed is:

1. In a folding component cosmetic compact, the combination comprising a) base, insert and cap components, b) there being a first hinge connecting the insert component to the base component and a second hinge connecting the insert component to the cap component, c) said hinges being foldable living hinges, d) said components having a substantially horizontally linearly extended position in which the living hinges are substantially horizontally aligned, e) said components having a collapsed position in which one living hinge is concealed by primary peripheral portions defined by the cap and base components so that said primary peripheral portions block all exposure of the one living hinge to the exterior of the compact, and the other living hinge is concealed by secondary peripheral portions defined by the cap and insert components so that said secondary peripheral portions block all exposure of the other living hinge to the exterior of the compact, said primary and secondary peripheral portions bounding all of said living hinges in said collapsed position, f) the entireties of said base, cap components, and living hinges have a one-piece construction, g) one living hinge projecting relatively sidewardly but entirely inside the periphery of the base component, and the other living hinge projecting relatively downwardly entirely outside the periphery of the insert component, said other living hinge in said compact fully collapsed position retainer concealed between wall positions defined by the base and cap components, and said one living hinge in said compact fully collapsed position being retained between wall positions defined by the insert and cap components, h) the living hinges being everywhere entirely outside the entirety of a re-entrant interior space defined by the insert, i) the base component having a re-entrant recess into which the insert component projects in said collapsed position, the cap component then overlying the base component, insert component, and the living hinges, j) and including a concealed clasp acting to releasably hold such components in closed together condition k) wherein said peripheral portions on the base, insert and cap components project and between which the living hinges become encompassed, as the components guidedly collapse together.

2. The combination of claim 1 wherein in said extended position the hinges are unfolded.

3. The combination of claim 2 wherein the base component, insert component, and cap component have a stair-step configuration in said extended position.

4. The combination of claim 1 wherein the components and hinges form a Z shaped configuration.

5. The combination of claim 1 wherein said peripheral portions on the base, insert and cap components project and between which the living hinges become encompassed, as the components guidedly collapse together.

6. The compact of claim 5 wherein in said linearly extended position, the base, insert and cap components extend in substantially parallel relation, the cap and base components located at different levels.

7. The compact of claim 6 wherein the insert component is located at a level between the cap and base component levels.

8. The compact of claim 6 wherein the cap, insert and base components are generally circular in outline, there being vent openings in the base and insert components to pass air from the compact interior to the exterior as the compact is closed to move the vent openings relatively toward one another, and in registered relation, the first and second hinges projecting in different directions and away from the insert component in said extended position.

9. The combination of claim 1 wherein one of the living hinges forms said clasp.

* * * * *